United States Patent [19]

Fukano et al.

[11] Patent Number: 5,070,373

[45] Date of Patent: Dec. 3, 1991

[54] FIXING DEVICE

[75] Inventors: Masahiko Fukano; Toshinori Muraoka, both of Osaka, Japan

[73] Assignee: 501 Mita Industrial Co., Ltd., Osaka, Japan

[21] Appl. No.: 483,554

[22] Filed: Feb. 22, 1990

[30] Foreign Application Priority Data

Feb. 23, 1989 [JP] Japan ..... 1-44345

[51] Int. Cl.[5] ..... G03G 15/20

[52] U.S. Cl. ..... 355/290; 219/216; 355/282

[58] Field of Search ..... 219/216, 388, 469; 355/282, 283, 284, 285, 289, 290, 291, 294, 295; 432/60, 75, 228

[56] References Cited

U.S. PATENT DOCUMENTS 3,637,976 1/1972 Ohta et al. ..... 432/75
4,231,653 11/1980 Nagahara et al. ..... 355/283
4,523,836 6/1985 Nepper et al. ..... 355/310
4,967,237 10/1990 Sasaki et al. ..... 355/290

FOREIGN PATENT DOCUMENTS 0321162 9/1988 United Kingdom ..... 355/295
2209709 5/1989 United Kingdom ..... 355/295

*Primary Examiner*—A. T. Grimley
*Assistant Examiner*—Christopher Horgan
*Attorney, Agent, or Firm*—Beveridge, DeGrandi & Weilacher

[57] ABSTRACT

Disclosed is a fixing device wherein a pressure belt is rotated independently of a heating roller in the paper delivery direction by second driving means including a one-way clutch which allows racing thereof in the paper delivery direction. The pressure belt is rotated at a peripheral speed less than that of the heating roller by the second driving means. The fixing device can surely perform fixation without causing defective delivery or crumple regardless of papers or plastic films.

3 Claims, 5 Drawing Sheets

FIXING DEVICE

The present invention relates to a fixing device and more particularly to a device for fixing toner images transferred onto the surface of a paper, which is used in an image forming apparatus such as an electrostatic copying apparatus, a printer, a facsimile and the like.

The fixing device comprises a heating roller which is heated to a predetermined temperature by a heater and is rotated by driving means and pressure means come into contact with the heating roller. The fixing device heats, pressurizes and thereby fixes the toner images on the paper by inserting the paper, onto which the toner images are transferred, between the heating roller and the pressure means.

A pressure roller or a pressure belt is used as the pressure means. In particular, the pressure belt, which is wound onto a pair of belt pulleys, can fix the toner images at a lower temperature and lower pressure, because a contact area of the pressure belt with the heating roller can be wider than that of the pressure roller. For this reason, the advantage of the fixing device using the pressure belt is that the papers are rarely crumpled. Then, the pressure belt is preferably used in the large-sized fixing device corresponding to the wide papers such as A0-sized ones and the like. The pressure belt is not usually driven with the driving means. The pressure belt is rotated along with the rotation of the heating roller by friction between surfaces of the heating roller and the pressure belt.

In the fixing device, the heating roller, of which surface is coated with polytetrafluoroethylene (PTFE), is used in order to ensure heat resistance. Also, the pressure belt formed of silicone rubber is used in order to ensure the heat resistance.

Toner may be easily adhered onto the surface of the pressure belt formed of silicone rubber. The toner, which is adhered onto the surface of the pressure belt, causes the paper to be made dirty. Then, the surface of the pressure belt is coated with fluorine-contained rubber latex to prevent the toner from being adhered.

However, the fluorine-contained rubber latex thus coated has a small coefficient of friction. Moreover, as compared with the pressure roller, the pressure belt is come into contact with the heating roller at lower pressure as described above. For this reason, the pressure belt can be easily slipped off the heating roller and the papers. The pressure belt is driven through the friction with the heating roller. Therefore, if the slipping is caused with the papers interposed between the pressure belt and the heating roller, the pressure belt may be stopped rotating and defective delivery of papers may be caused. In particular, if the area of the toner images transferred onto the paper is small, the defective delivery of papers is frequently caused because the papers are easily slipped off the heating roller.

Then, a fixing device is invented, which comprises a pressure belt provided with driving means for rotating independently of a heating roller. However, in the case that the heating roller and the pressure belt are separately rotated, it is difficult to perfectly synchronize a peripheral speed of the heating roller with that of the pressure belt because of mechanical error, the difference of working precision, the difference of dimensional precision and the like of a power transmission mechanism etc.

In the foregoing, the papers can be easily slipped off the heating roller and the pressure belt, so that the papers are not affected by the error between the peripheral speed of the heating roller and that of the pressure belt.

However, in the case that the toner images are fixed on the surface of a plastic film such as polyethylene, polyester or the like used for a document of an overhead projector and the like in place of the aforementioned paper, the plastic film is adversely affected by the error between the peripheral speed of the heating roller and that of the pressure belt. Because, the plastic film is softened by heat of the heating roller, and thereby adhered onto both the heating roller and the pressure belt satisfactorily. Thus, if there is a difference between the peripheral speed of the heating roller and that of the pressure belt, the plastic film may become crumpled and what is worse, may be damaged.

SUMMARY OF THE INVENTION

The primary object of the present invention is to provide a fixing device for surely performing fixation without causing defective delivery or crumple regardless of papers or plastic films.

According to the present invention, a device for fixing toner images transferred onto the surface of a paper is provided, which comprises a heating roller rotated by first driving means and a pressure belt come into contact with the heating roller and characterized in that the pressure belt is rotated in the paper delivery direction by second driving means including a one-way clutch which allows racing of the pressure belt in the paper delivery direction and that the pressure belt is rotated by the second driving means at a peripheral speed less than that of the heating roller.

The one-way clutch which transmits torque along with the rolling of balls or rollers arranged around a shaft, for example, one which includes the lot of rollers arranged around the shaft and an outer ring accomodating rollers with interposed between shafts and having a lot of grooves inclined in the circumferential direction, and transmits torque by tightly holding the rollers between the grooves of the outer ring and the outer circumferential face of the shaft, can be used.

Moreover, the second driving means may be used, wherein a pair of flat gears rotated integrally with the heating roller are included and gear ratio thereof is set so that the pressure belt may be rotated at the peripheral speed less than that of the heating roller.

When the toner images are fixed on the surface of the paper using the fixing device of the present invention, the pressure belt directly receives rotating force from the heating roller by friction between surfaces of the heating roller and the pressure belt if slipping is not caused between the heating roller and the paper and between the paper and the pressure belt. For this reason, the pressure belt is driven with the heating roller by the one-way clutch without receiving driving force from the second driving means. On the other hand, when the toner images are fixed on the surface of the paper, the pressure belt is driven independently of the heating roller by the second driving means so that the rotation of the pressure belt cannot be stopped if the slipping is caused between the heating roller and the paper and between the paper and the pressure belt. Thereby, the papers are surely delivered while receiving delivery force from both the heating roller and the pressure belt. In this case, the papers can be easily slipped off the heating roller and the pressure belt as described above, so that they are not affected by the difference between the peripheral speed of the heating roller and that of the pressure belt and therefore can be delivered without causing crumple or damage.

When the toner images on the surface of the plastic film are fixed using the fixing device of the present invention, the plastic film is come into contact with both the heating roller and the pressure belt. For this reason, the pressure belt is caused to directly receive the rotating force from the heating roller, is driven with the heating roller by the one-way clutch without receiving the driving force from the second driving means, and is thereby rotated at the peripheral speed equal to that of the heating roller. Therefore, the plastic film can be delivered without causing crumple or damage.

When the second driving means includes the pair of flat gears which are rotated integrally with the heating roller and of which gear ratio is set so that the pressure belt may be rotated at the peripheral speed less than that of the heating roller, there is an advantage that the structure of the second driving means can be simple.

DESCRIPTION OF THE PREFERRED EMBODIMENTS

Figure 2:
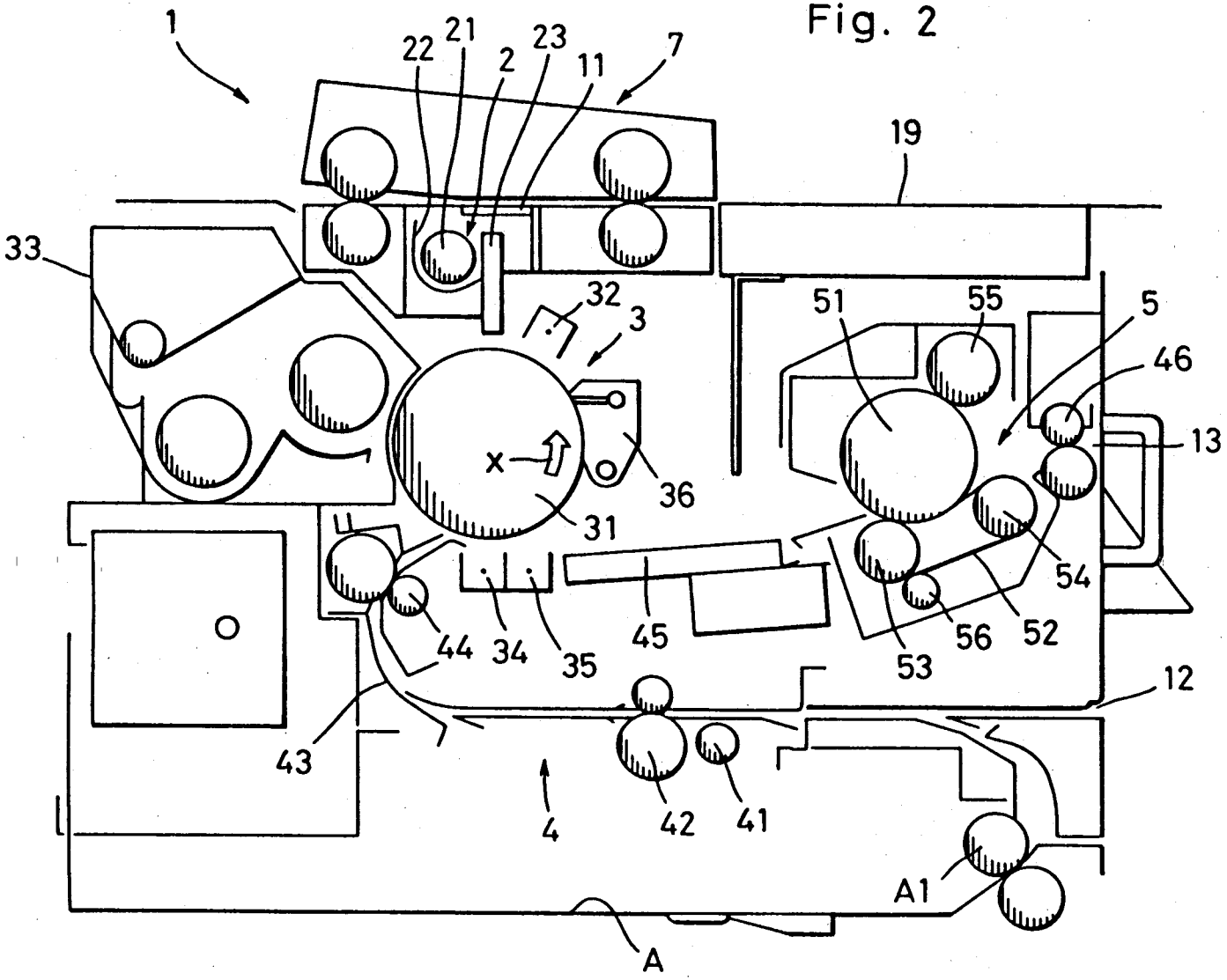
FIG. 2 is a schematic view illustrating the internal structure of an electrostatic copying apparatus to which the fixing device is attached.

FIG. 2 is a schematic view illustrating the internal structure of an electrostatic copying apparatus to which a fixing device 5 of the present invention is attached. The electrostatic copying apparatus comprises an optical system 2 for exposing and scanning documents above the internal portion of a body 1 and an image forming section 3 for forming images copied by toner to transfer the toner onto papers (not shown) therebelow. A paper delivery section 4 is provided from the lower portion of the image forming section 3 to the upper portion on the right hand in FIG. 2. The fixing device 5 is arranged in the middle of the downstream side of the paper delivery section 4.

The optical system 2 includes a light source 21, a reflector 22 and an optical element 23. The optical system 2 is capable of exposing and scanning an original document which is travelled on a transparent platen 11 by the document delivery means 7. The original document is inserted from a document inserting tray 19 on the upper surface of the body 1 to the document delivery means 7.

The image forming section 3 has a corona discharger 32, a developing device 33, a transferring corona discharger 34, a separating corona discharger 35 and a cleaner 36 around a photo-receptor drum 31 which is rotated in the direction of the arrow X in FIG. 2. The image forming section 3 first forms electrostatic latent images onto the photoreceptor drum 31, of which surface is evenly charged by the corona discharger 32, by forming the document images by means of the optical system 2. Next, the electrostatic latent images are developed into toner images by the developing device 33, and thereafter the toner images are transferred onto the surface of the paper or plastic film by the transferring corona discharger 34. Then, the paper or plastic film, onto which the toner images are transferred, is separated from the photoreceptor drum 31 by the separating corona discharger 35 to withdraw the residual toner on the surface of the photoreceptor drum 31 by means of the cleaner 36.

The paper delivery section 4 has a paper feeding roller 41, a registration roller 42, a paper guide plate 43, a delivery roller 44, a paper guide plate 45 and a discharge roller 46 from the inner portion of a paper inserting port 12 to a paper discharge port 13. The paper delivery section 4 guides the paper fed from a paper cassette A or the paper inserting port 12, which is arranged on the lower portion of the body, to the image forming section 3 by rotating the paper feeding roller 41, and thereby the toner images are transferred. Then, the toner images are heated, pressurized and thereby fixed by means of the fixing device 5. Thereafter, the paper is discharged out of the paper discharge port 13. A paper feeding roller A1 is provided on a front end of the paper cassette A in order to take the papers therefrom one by one and to feed them.

Figure 1:
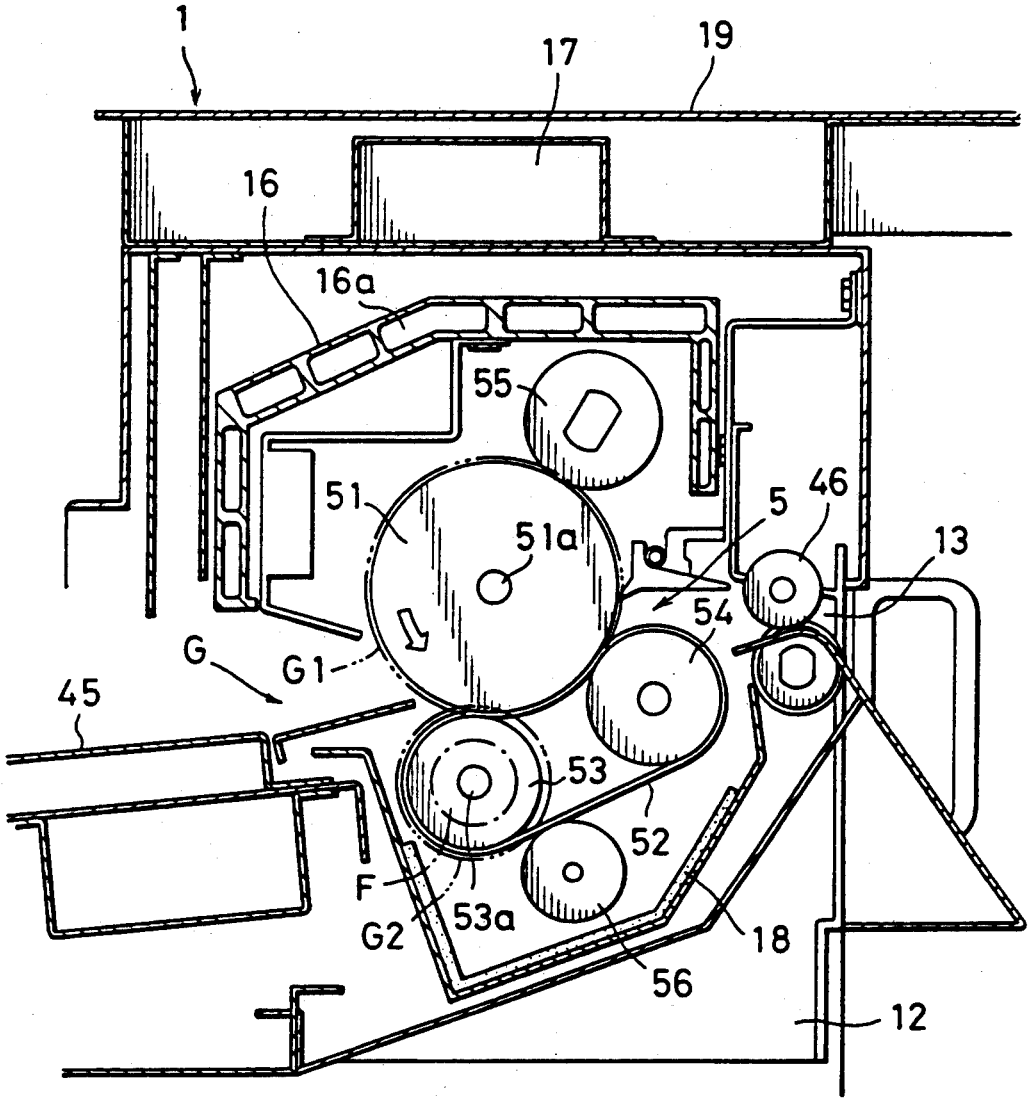
FIG. 1 is a sectional view illustrating a fixing device of the present invention.

As shown in FIG. 1, a heat insulating cover 16 having a pneumatic layer **16*a* inside thereof and an exhaust duct 17 are provided above the inner portion of the body 1 to which the fixing device 5 is attached. The heat insulating cover 16 is provided to intercept hot air from a heating roller 51 and to keep warm the fixing device 5 and is molded with plastic in its entirety. On the other hand, the exhaust duct 17 is provided in order to prevent the interior of the body 1 from being heated more than required and to prevent the document inserting tray 19 on the top surface of the body 1 from being heated, by the heat of the fixing device 5. Moreover, an adiabator 18 is arranged in the lower portion of a pressure belt 52 in order to keep warm the fixing device 5 and to prevent the paper inserting port 12** therebelow from being heated.

As shown in FIG. 1, the fixing device 5 is arranged with the heating roller 51 come into contact with the pressure belt 52. The fixing device 5 can fix the toner images by inserting the paper or plastic film onto which the toner images are transferred between the heating roller 51 and the pressure belt 52. The pressure belt 52 is come into contact with the heating roller 51 with being wound onto a pair of belt pulleys 53 and 54 spaced apart from each other. In addition to a cylindrical shape, the shape having the outer circumferential face winding the pressure belt 52 crowned can be used as the pair of belt pulleys 53 and 54.

The heating roller 51 is rotated with being heated to a predetermined temperature by means of heating means such as a heater or the like provided therein, by first driving means D (See FIG. 5) attached to one end of a driving shaft **51*a* (an end on this side thereof in FIG. 1) in the direction of an arrow in FIG. 1**.

Figure 5:
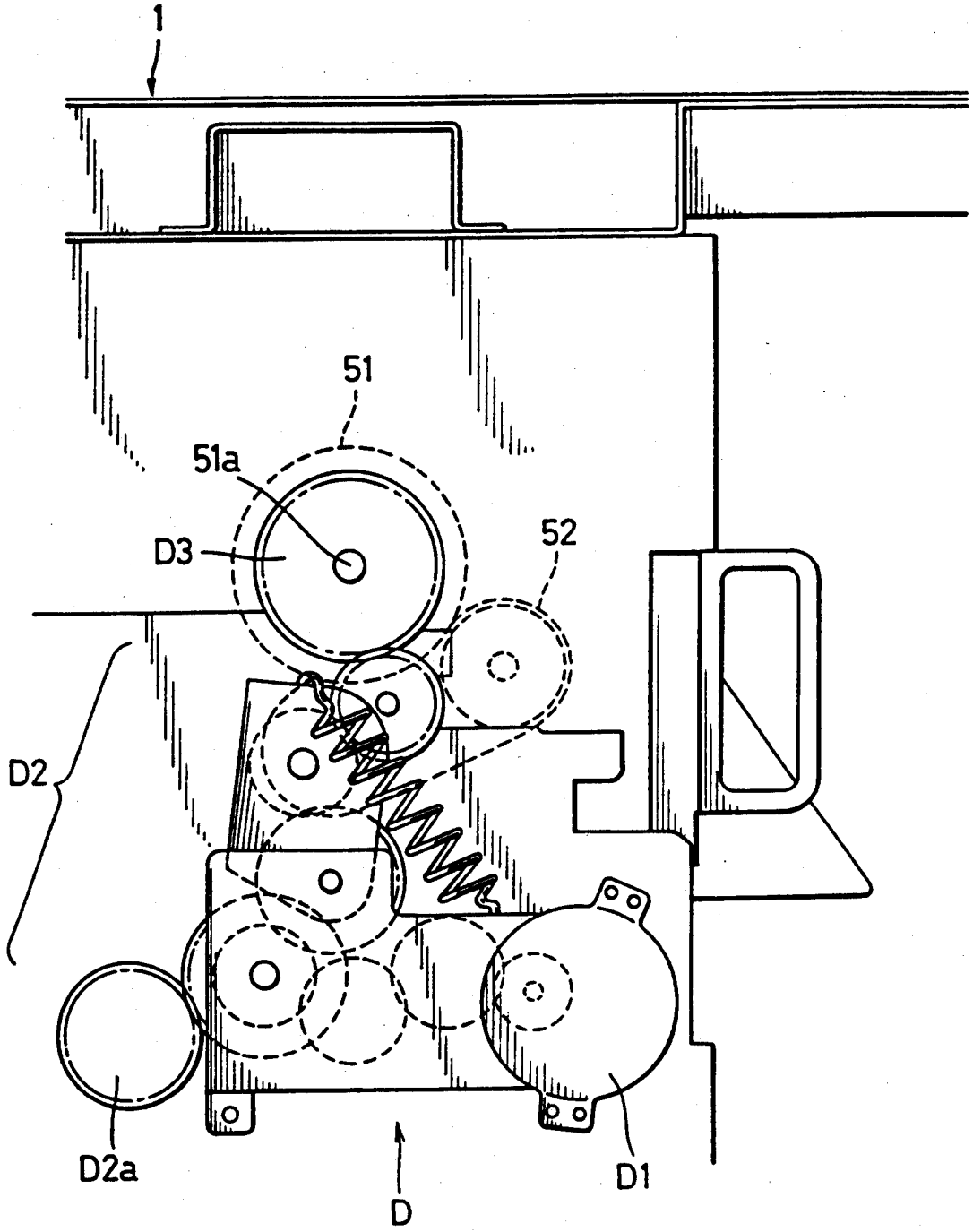
FIG. 5 is a front view illustrating first driving means used in the fixing device.

As shown in FIG. 5, the first driving means D includes an auxiliary motor D1, a gear device D2 which is driven by the auxiliary motor D1 and a gear D3 which is attached to one end of the driving shaft **51*a* and connected to the gear device D2. At the time of fixing operation, the first driving means D is rotated at a predetermined speed by means of a driving source of the body (not shown) which is connected to a gear D2*a* of the gear device D2**. At the time of the operations other than the fixing one, the first driving means D is rotated at a low speed by means of the auxiliary motor D1.

The other end of the driving shaft 51*a* of the heating roller 51 is provided with second driving means G for rotating the pressure belt 52. The second driving means G includes a pair of flat gears G1 and G2 which engage each other and a one-way clutch F (See FIG. 3) which allows racing of the pressure belt in the paper delivery direction. The flat gear G1 is attached to the end of the side opposed to the side, to which the first driving means D is attached, of the driving shaft 51*a* of the heating roller 51. The one-way clutch F is attached to the end on the side corresponding to the flat gear G1, of the driving shaft 53*a* of the belt pulley 53. The flat gear G2 which engages the flat gear G1 is attached to the one-way clutch F. As shown in FIG. 1, the driving shaft 53*a* of the belt pulley 53, the one-way clutch F and the flat gear G2 are arranged concentrically.

When the heating roller 51 is rotated by the first driving means D, the belt pulley 53 is rotated through the second driving means G and thereby the pressure belt 52 is rotated in the paper delivery direction. Furthermore, the gear ratio of the flat gear G1 and G2 are set so that the peripheral speed of the pressure belt 52 may be less than that of the heating roller 51 even if the mechanical error, the difference of working precision, the difference of dimensional precision and the like are taken into consideration.

Figure 3:
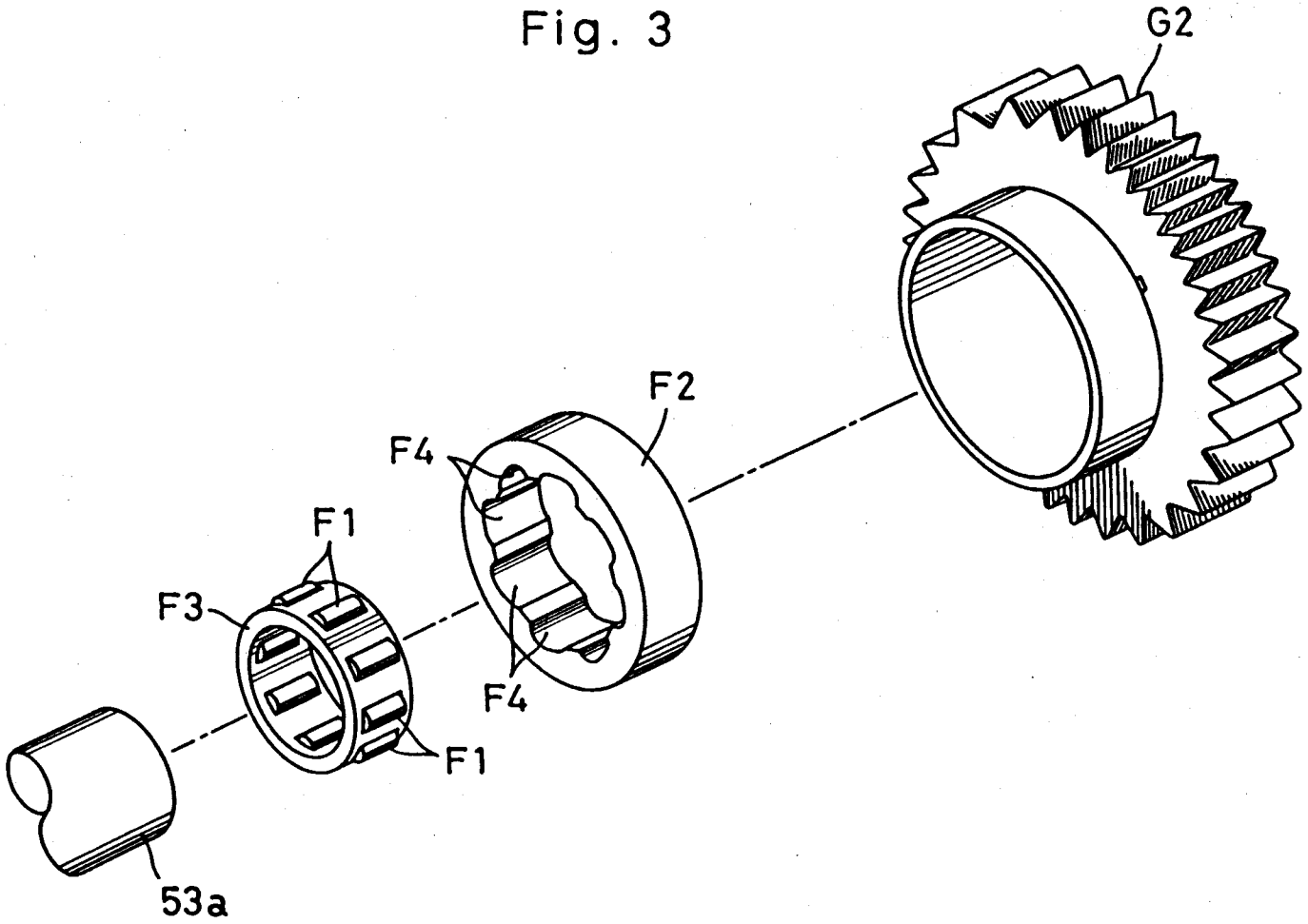
FIG. 3 is a perspective view illustrating an one-way clutch used in the fixing device.
Figure 4:
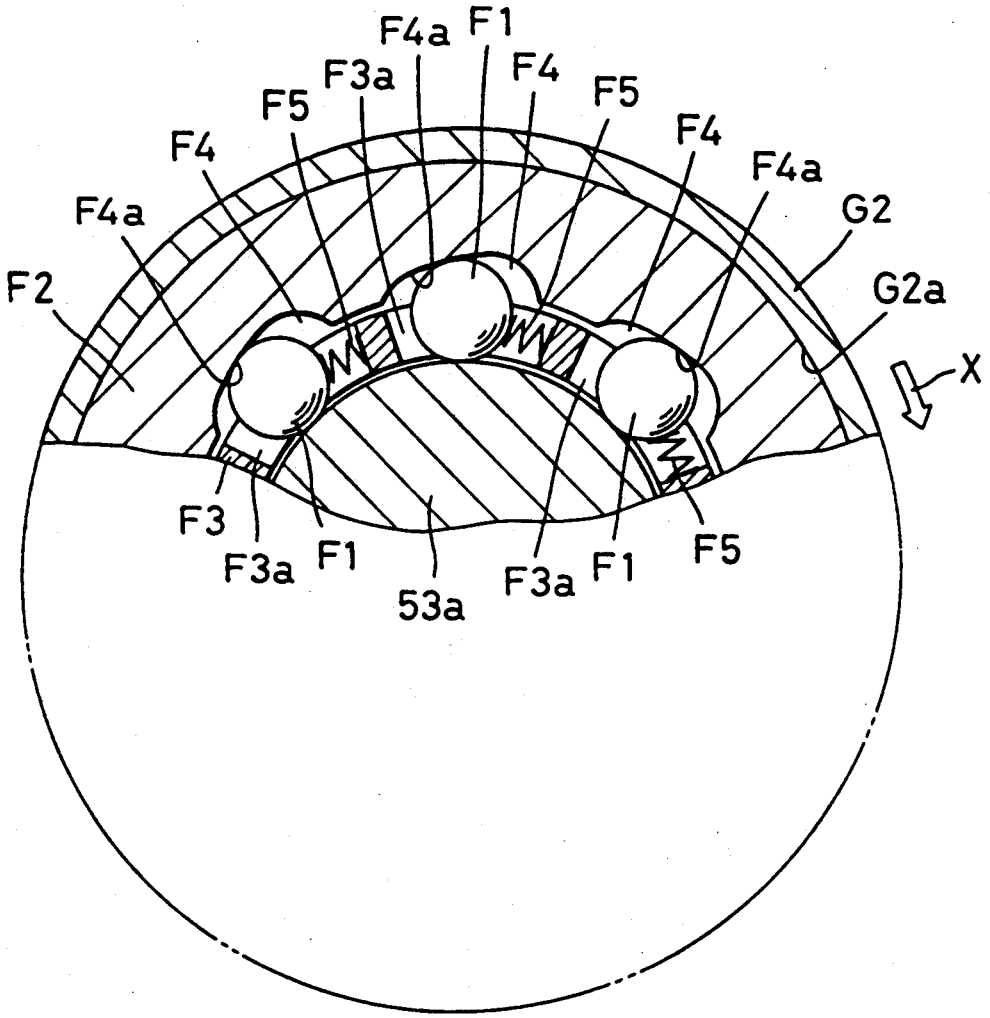
FIG. 4 is a sectional view of the one-way clutch.

As shown in FIGS. 3 and 4, the one-way clutch F includes a plurality of rollers F1 . . . arranged around the driving shaft 53*a* of the belt pulley 53, an outer ring F2 fit into a shaft hole G2*a* of the flat gear G2 and a ring-like retainer F3 inserted between the outer ring F2 and the driving shaft 53*a* for retaining the rollers F1 . . . .

The rollers F1 . . . are arranged with a shaft axis thereof directed in parallel with the shaft axis of the driving shaft 53*a* of the belt pulley 53. Moreover, the rollers F1 . . . , which are retained by the retainer F3, are arranged around the driving shaft 53*a* at regular intervals.

The grooves F4 . . . are formed to accommodate the rollers F1 . . . on the internal circumference of the outer ring F2. The grooves F4 . . . are formed on the internal circumference of the outer ring F2 at regular intervals corresponding to the arrangement of the rollers F1 . . . arranged around the driving shaft 53*a* at regular intervals by the retainer F3. The bottoms of the grooves F4 . . . are the cam faces F4*a* . . . which are gradually inclined in the circumferential direction. The cam faces F4*a* . . . of the grooves F4 . . . are inclined in the same direction viewed from the center of the outer ring F2. In FIG. 4, the cam faces F4*a* . . . are inclined so that the right sides of respective grooves F4 may be deeper than the left side thereof. The deepest portions of the grooves F4 . . . are set so that the radial spacing between the deepest portion of the cam face F4*a* and the outer circumferential face of the driving shaft 53*a* opposed thereto may be slightly larger than a diameter of the roller F1. Moreover, the shallowest portions of the grooves F4-are set so that the radial spacing between the shallowest portion of the cam face F4*a* and the outer circumferential face of the driving shaft 53*a* opposed thereto may be slightly smaller than the diameter of the roller F1.

The retainer F3 has through holes F3*a* . . . penetrated from the inner circumference to the outer circumference for retaining the rollers F1 . . . in the ring-like body. The through holes F3*a* . . . are formed in the ring-like body at regular intervals so as to arrange the rollers F1 . . . at regular intervals as described above. Moreover, the through holes F3*a* . . . are provided with springs F5 . . . for pressing the rollers F1 . . . in the direction of the shallower portion of the cam face F4*a*, that is, in the counterclockwise direction in FIG. 4.

In the one-way clutch F, when the heating roller 51 and the pressure belt 52 are slipped and thereby the pressure belt 52 is stopped driving with the heating roller 51, the rollers F1 . . . are pressed by the pressure of the spring F5 in the counterclockwise direction in FIG. 4, that is, in the direction such that the radial spacings between the cam faces F4*a* . . . and the outer circumferential face of the driving shaft 53*a* may be smaller than the diameters of the rollers F1 . . . . Thereby, the outer ring F2 and the driving shaft 53*a* are locked by the rollers F1 . . . and then the torque of the outer ring F2 is transmitted to the driving shaft 53*a*. Thereafter, the driving shaft 53*a* is rotated along with the rotation of the outer ring F2 in the paper delivery direction arrowed by X in FIG. 4. Accordingly, when the papers are fixed using the fixing device 5, the pressure belt 52 is rotated through the second driving means G, that is, the flat gears G1 and G2 and the one-way clutch F, and then the papers are surely delivered while receiving the delivery force from both the heating roller 51 and the pressure belt 52 if the slipping is caused. In this case, the papers can be easily slipped off the heating roller 51 and the pressure belt 52 as described above, so that the papers are not affected by the difference between the peripheral speed of the heating roller 51 and that of the pressure belt 52. Accordingly, the papers are delivered without causing crumple or damage.

On the other hand, when the pressure belt 52 is driven with the heating roller 51 and thereby rotated at a higher speed than the peripheral speed set by the second driving means G, the driving shaft 53*a* is rotated at a higher rotating speed than that of the outer ring F2 locked into the flat gear G2 in the paper delivery direction. Then, the rollers F1 . . . are put out in the clockwise direction in FIG. 4, that is, in the direction such that the radial spacings between the cam faces F4*a* . . . and the outer circumferential face of the driving shaft 53*a* are larger than the diameters of the rollers F1 . . . . For this reason, clearance is caused between the outer ring F2 and driving shaft 53*a* and the rollers F1 . . . and thereby the outer ring F2 and the driving shaft 53*a* are made free each other. Accordingly, when the plastic film, which is come into contact with both the heating roller 51 and the pressure belt 52, is fixed using the fixing device 5, the pressure belt 52 is rotated at the peripheral speed equal to that of the heating roller 51 without receiving the driving force by the second driving means G. Therefore, the plastic film is delivered without causing crumple or damage.

The pressure belt 52 is come into contact with a roller 56 for applying oil as release agent in order to prevent the toner from being adhered onto the surfaces of the heating roller 51 and of the pressure belt 52. The heating roller 51 is come into contact with a cleaning roller 55 which removes the oil adhered onto the outer circumferential face thereof.

It will be understood that the fixing device of the present invention is not to be limited to the aforementioned embodiment but that various modifications and alterations can be made without departing from the scope and spirit of the invention.

By way of example, while the second driving means G including the pair of flat gears G1 and G2 which are rotated integrally with the heating roller 51 is used in order to rotate the pressure belt 52 in the above embodiment, the second driving means G may be driven by means of an exclusive driving source thereof.

The one-way clutch F is not necessarily positioned between the flat gear G2 and the driving shaft 53*a* of the belt pulley 53 but can be suitably positioned, for example, between the driving shaft 51*a* of the heating roller 51 and the flat gear G1.

In addition to the one-way clutch shown in FIGS. 3 and 4, the one-way clutch, whose rollers and shafts have inclines, can be used for transmitting the torque along with the rotation of the balls or rollers arranged around the shaft. Moreover, in addition to the one-way clutch using the balls or rollers, a spring clutch utilizing variation of radial or longitudinal dimension of a coil spring, a ratchet clutch and the like can be used.

Furthermore, the fixing device of the present invention can be applied to various image forming apparatus such as a facsimile, a printer and the like other than the electrostatic copying apparatus wherein toner images need to be fixed on the papers or plastic films, onto which the toner images are transferred, by inserting the papers or plastic films between the heating roller and the pressure belt come into contact therewith.

What is claimed is:

1. A device for fixing toner images transferred onto the surface of a paper comprising:

(i) a heating roller;

(ii) first driving means for driving said heating roller;

(iii) a pressure belt which comes into contact with and is driven with said heating roller; and (iv) second driving means for driving said pressure belt at a lower peripheral speed than that of said heating roller when slippage occurs between said heating roller and the paper and between the paper and said pressure belt so that the peripheral speed of said pressure belt becomes lower than that of said heating roller, wherein the second driving means includes a one-way clutch which allows racing of said pressure belt in a paper delivery direction so that said pressure belt can be rotated at the same peripheral speed as that of said heating roller when the slippage does not occur between said heating roller and the paper and between the paper and said pressure belt.

2. A device according to claim 1 wherein the one-way clutch is for transmitting torque through rolling balls or rollers arranged around a shaft.

3. A device according to claim 1 wherein the second driving means includes a pair of flat gears which are rotated integrally with the heating roller and gear ratio thereof is set so that the pressure belt may be rotated at the peripheral speed less than that of the heating roller.

* * * * *